US006846619B2

(12) United States Patent
Kaneko et al.

(10) Patent No.: US 6,846,619 B2
(45) Date of Patent: Jan. 25, 2005

(54) DYE DISPERSION LIQUID AND THERMOSENSITIVE RECORDING MATERIAL USING THE SAME

(75) Inventors: Yoshikazu Kaneko, Numazu (JP); Yasutomo Mori, Numazu (JP); Kunio Hayakawa, Mishima (JP); Mitsunobu Morita, Numazu (JP); Takeshi Kajikawa, Shizuoka (JP); Shuuji Miyamoto, Numazu (JP); Yuuichi Kawaguchi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 10/103,974

(22) Filed: Mar. 22, 2002

(65) Prior Publication Data

US 2003/0060366 A1 Mar. 27, 2003

(30) Foreign Application Priority Data

Mar. 23, 2001 (JP) ..... P2001-086333
Mar. 20, 2002 (JP) ..... P2002-077566

(51) Int. Cl.[7] ..... G03C 1/73; G03C 5/22; B41M 5/20; B41M 5/24; B01F 3/00

(52) U.S. Cl. ..... 430/338; 106/31.2; 252/363.5; 503/209; 503/213; 503/218

(58) Field of Search ..... 503/209, 213, 503/218; 430/338; 106/31.2; 252/363.5

(56) References Cited

U.S. PATENT DOCUMENTS

| | | | | |
|---|---|---|---|---|
| 4,864,024 | A | | 9/1989 | Sato et al. |
| 5,387,488 | A | | 2/1995 | Kaneko et al. |
| 5,397,594 | A | * | 3/1995 | Koyabu et al. |
| 5,446,011 | A | | 8/1995 | Hayakawa et al. |
| 5,447,900 | A | | 9/1995 | Suzaki et al. |
| 5,489,501 | A | | 2/1996 | Torii et al. |
| 5,536,697 | A | | 7/1996 | Hada et al. |
| 5,547,802 | A | | 8/1996 | Kawase et al. |
| 5,622,909 | A | | 4/1997 | Furuya et al. |
| 5,646,088 | A | | 7/1997 | Hada et al. |
| 5,703,006 | A | | 12/1997 | Mori et al. |
| 5,721,190 | A | | 2/1998 | Miyamoto et al. |
| 5,792,724 | A | | 8/1998 | Suzaki et al. |
| 5,827,590 | A | | 10/1998 | Morita et al. |
| 5,919,729 | A | | 7/1999 | Mori et al. |
| 5,972,836 | A | | 10/1999 | Morita et al. |
| 6,060,427 | A | | 5/2000 | Mori et al. |
| 6,180,560 | B1 | | 1/2001 | Hayakawa et al. |
| 6,395,680 | B1 | | 5/2002 | Morita et al. |
| 6,400,492 | B1 | | 6/2002 | Morita et al. |
| 6,593,272 | B2 | * | 7/2003 | Kakuda et al. |
| 6,660,688 | B2 | * | 12/2003 | Yamada et al. |
| 2001/0005567 | A1 | | 6/2001 | Harada et al. |

FOREIGN PATENT DOCUMENTS

| | | | |
|---|---|---|---|
| EP | 0630758 | | 12/1994 |
| EP | 1080940 | | 3/2001 |
| EP | 1243437 | * | 9/2002 |
| GB | 2085179 | * | 4/1982 |
| JP | 07/186527 | * | 7/1995 |
| JP | 07/186531 | * | 7/1995 |
| JP | 07/223375 | * | 8/1995 |

OTHER PUBLICATIONS

Patent Abst. of Japan, Abstr of JP 6/206374 Narizuka et al., Jul. 1994.*

U.S. patent Appl. No. 09/497,947 of Katoh et al., filed Feb. 4, 2000.

U.S. patent appl. No. 09/694,000 of Hayakawa et al., filed Oct. 23, 2000.

U.S. patent appl. No. 09/728,306 of Kakuda et al., filed Dec. 1, 2000.

U.S. patent appl. No. 09/867,557 of Yamada et al., filed May 30, 2001.

* cited by examiner

*Primary Examiner*—Richard L. Schilling
(74) *Attorney, Agent, or Firm*—Cooper & Dunham LLP

(57) ABSTRACT

There is provided a leuco dye dispersion liquid for a thermosensitive recording material wherein the leuco dye is being dispersed with an anionic surfactant and an nonionic surfactant, while average particle diameter of the leuco dye ranges from 0.10 $\mu$m to 0.30 $\mu$m and content of particles less than or equal to 0.07 $\mu$m in diameter of the dye is not greater than 1.0%. The leuco dye dispersion liquid shows no fogging, and can cause a high optical density of image on thermosensitive member with excellent brightness in background area, and a high durability for storage at elevated temperature.

27 Claims, No Drawings

DYE DISPERSION LIQUID AND THERMOSENSITIVE RECORDING MATERIAL USING THE SAME

BACKGROUND OF THE INVENTION

1. Field of the Invention

The present invention relates to a thermosensitive recording material, Particularly, to a thermosensitive recording material which shows a high optical density of colored image and excellent brightness of background area, while has an improved storage stability in both colored image and background area.

2. Description of the Related Art

In accompanied with ever-expanding requirement for information and diversified kind of information in recent yeas, a many variety of recording materials are researched, developed and used in real in the field of information recording. Among them, there are used thermal recording materials which (1) can record images thereon with a simple thermal process and (2) can save the cost in lower level and be handled with much ease as subjected to printing action with a printing machine of simple mechanism, thus being utilized in various applications including the data processing (for data outputs of a desktop calculator or computer), the medical measurement recording, the facsimile acting at low and high speeds, the automatic ticket issuing (ride tickets and admission tickets), the thermal copy machine, and the labeling in POS system.

Such thermal recording materials are essentially desired to develop high optical density of color image with speedy processing and to prolong both life of image and life of background area.

Among those for satisfying that purposes, in particular, for developing high optical density of color image even if in quick development (=to show high sensitivity), additives for the thermosensitive material have been studied which may compose an eutectic mixture in jointing with leuco dye as colorant or electron-acceptor compound as color developer used in thermosensitive material to lower the melting point of the mixture. It can say that the lowering of melting point of the colorant and/or the color developer are basically efficient for increase sensitivity, however causes inevitable drop of coloring temperature, therefore, such kind of improvement in sensitivity shall concur a tinting(fogging) of background area at low temperature. Furthermore, from the point of view of improving the resistibility for affection of chemicals, there have been recently proposed color developers which are increased in the molecular weight (WO 99/51444, WO 00/14058 and Japanese Laid-open Patent Publication of Tokkai Hei 8-333329). Those color developers having high molecular weight are however still insufficient in the sensitivity and the optical density of colored image, thus higher sensitizing having been desired.

On the other hand, as other means for increasing the sensitivity of thermosensitive recording materials, various attemps have been made for giving smaller particles of leuco dye to achieve higher sensitivity with the recording materials. For example, the use of a leuco dye having average volumetric particles diameter not higher than 2 μm (Japanese Laid-open Patent Publication of Tokkai Shou 57-47693), the use of mixture consisting of two or more different type of leuco dyes which being pulverized jointly and have average particle diameters not higher than 2 μm (Japanese Laid-open Patent Publication of Tokkai Hei 7-223375), and a thermosensitive recording member using a leuco dye having an average particle diameter of 0.1 to 0.8 μm, a developer and a colloidal silica (Japanese Laid-open Patent Publication of Tokkai Hei 7-186527), and the like are instanced.

Those pulverization(in other words milling) processes to make a desired size of the leuco dye particles may be conducted using a cellulosic polymer material soluble in water such as polyvinyl alcohol, and the dispersing action of a dispersing machine, such as a ball mill, a sand mill, a high-speed jet mill, or an attrititon apparatus. However the pulverization processes have problems that more labor, time and machine are required for decreasing the size of leuco dye particles hence resulting cost elevation, and secondary aggregation is likely to occur in liquid thus declining stability of the liquid, particularly in case of being pulverized to the size less than or equal to 0.3 using water soluble polymer material, because a great many of activated surfaces are presented at dye particles due to cleavage and abrasion thereof, and such activated surfaces of dye particles and prolonged period of pulverizing process may generate a tinting or fogging of dye-dispersion liquid hence lowering the brightness of background area of thermosensitive member prepared using the dye-dispersion liquid.

To evade above problems pertinent to mechanical dispersion process, there are provided methods for making smaller particles of leuco dye using emulsification process.

For examples, disclosed in Japanese Laid-open Patent Publication of Tokkai Shou 61-2187283 concerns to a method of emulsifying liquid of oil in water type in which a solution of an organic solvent containing a leuco dye dissolved therein is emulsified. The method however requires a step of removing the organic solvent after the finishing emulsification and the remained the organic solvent may develop an affect of background density(fogging or tinting). Disclosed in Japanese Laid-open Patent Publication of Tokkai Shou 56-164890 discloses another method of emulsifying a leuco dye and a thermally fusible material jointly, however it lowers the melting point of the thermosensitive material thus causing the degradation of thermal stability during storage period. Disclosed in Japanese Laid-open Patent Publication of Tokkai Hei 7-186531 is a thermosensitive recording material which contains a leuco dye having an average volumetric particle diameter not higher than 0.3 μm and an ultraviolet ray absorbant, in which the preparing of small particles is carried out by heat-fusing the leuco dye then emulsifying the resultant by a high-pressure homogenizer with use of a silicon emulsifier.

Disclosed in Japanese Laid-open Patent Publication of Tokkai Hei 7-223379 concerns a leuco dye having an average particle size not higher than 1.0 μm which is being emulsified and dispersed, in which the leuco dye is obtained by heat-fusing a leuco dye, then emulsifying and dispersing the resultant. In general, however the melting point of leuco dye is higher than 150° C., therefore as shown in above disclosed in Japanese Laid-open Patent Publications of Tokkai Hei 7-186531 and Tokkai Hei 7-223379, the heat-fusion and emulsification thereof in water can be conducted by use of a particular system such as a high-pressure container and the like, thus a mass-production thereby will be implemented with much difficulty.

With regard to the supporting substrate for thermosensitive material, besides the use of general wood free paper, there are known the uses of synthetic fiber paper, a plastic film and the like, it has been however required in recent years that the used papers are recovered and re-used from the point of view of resources saving. Disclosed in Japanese Laid-open Patent Publications of Tokkai Shou 58-25986 and Tokkai 2000-272248 are a thermosensitive recording paper which employ a paper board substrate containing a pulp recovered from used paper and thereon is applied a thermosensitive layer. However, the use of supporting substrate containing a pulp recovered from used paper causes a problem that stability during storage is declined.

SUMMARY OF THE INVENTION

It is hence an object of the present invention to improve above mentioned drawbacks in prior arts, and to provide a thermosensitive recording material which, in case of a dispersion processing using dispersion media, shows an excellent productivity, no tinting(fogging), no aggregation, and enables to give smaller particles of leuco dye to achieve higher sensitivity, and in case of it being rendered to a thermosensitive member, shows a high sensitivity for color-developing, a high brightness of background area, and excellent stability both of developed image and background area in prolonged storage period.

We, the inventors, have studied with the mechanical dispersion, and as a result, by mean of using an anionic surfactant, an anionic surfactant or coincident using a non-ionic surfactant with an anionic surfactant as dispersant, eventually found out a preparation method of smaller particles of leuco dye-dispersion liquid which shows an excellent productivity, no tinting(fogging), no aggregation, thus secondary aggregation of the dye particles and tinting of the liquid are eliminated, and a period of time required for dispersing is shorten(improving of dispersion efficiency) in which the leuco dye particles have an average particle size ranging from 0.1 to 0.3 m.

Furthermore, there are provided a leuco dye-dispersion liquid wherein the anionic surfactant is a surfactant having poly oxyethylene group or groups, a leuco dye-dispersion liquid wherein the surfactant having poly oxyethylene group or groups is a surfactant having poly oxyethylene group or groups of adduct or adducts consisting of less than or equal to 15 moles of oxyethylene units, a leuco dye-dispersion liquid wherein the surfactant having at least a poly oxyethylene group which has a tail-end ether residue selected from a group consisting of alkyl group, alkylphenyl group, phenylxylyl group, stylylphenyl group, a leuco dye-dispersion liquid wherein the smallest dye particle ingredient having particle size less than 0.07 $\mu$m is not contained more than one percent, a leuco dye-dispersion liquid wherein the surfactant is contained from 5 to 25 weight % for the leuco dye content, a leuco dye-dispersion liquid wherein a silicone emulsion ranging from 1 to 10 weight % for the leuco dye content is contained, a leuco dye-dispersion liquid wherein a polymer dispersant for the leuco dye is further contained, a leuco dye-dispersion liquid wherein partially saponified poly vinyl alcohol or poly vinyl alcohol-acryl sulphonic acid metal salt is contained.

It is known that with regard to water-soluble polymer as dispersant having been used heretofore, if milling is continued using the polymer as dispersant until less than 0.3 $\mu$m size of dye particles are attained, the polymer can not cover the surface increased by milling of dye particles, therefore loosing electric stability of the liquid and causing secondary aggregation therein. In general, where leuco dye is milled and dispersed using poly vinyl alcohol as dispersant, the smaller particle size causes the higher optical density of resultant liquid. And if developer is mixed, the coloring becomes more dominant, and if it is rendered to thermosensitive paper, the optical density of background area thereof is increased. The reason why such phenomena are caused is presumed, but the present invention is not restricted to the hypothesis, that the strong sharing power for milling to finer particle of dye makes change the un-saponified portion of poly vinyl alcohol to produce acetic acid, and the acetic acid makes lowering of the pH value of the dispersion liquid, thus effecting partial coloring(tinting) of the liquid, or makes non crystal state parts in particles, the non crystal state parts are likely to occur a coloring of the liquid, easy. Furthermore, the dispersion process using dispersion media requires a long period of the milling time to arrive to a fine dye particle size of 0.3 m level, thus the use in real was difficult.

According to the present invention, it is now discovered that many drawbacks in prior arts may be solved, by the use of a surfactant as a dispersant, instead of the water-soluble polymers which causes abovementioned many drawbacks in prior arts, thus the stability of fine particles of dye in liquid is increased, the period of dispersing time is made possible to shorten((enables improving of dispersion efficiency).

The nonionic surfactant used in the present invention includes a variety of compounds, and is instanced as poly oxyethylene alkylarylethers, poly oxyethylene alkylethers, poly oxyarylethers, poly alkyleneglycohols, poly oxyalkyleneglycohols sorbitan alkylates, satulated fatty acid esters, poly oxyethylene alkylesters, poly oxyethylene alkyl amines, poly oxyethylene sorbitanesters, poly oxyalkyleneglycohol alkylesters, fatty acid glycerin esters alkylalkylolamides, higher alcohols, and the like, More tangible examples, but not limits to are;

Poly oxyethylene octylphenyl ether,
Poly oxyethylene-2-ethylhexyl ether,
Poly oxyethylene lauryl ether,
Poly oxyethylene oleyl ether,
Poly oxyethylene tridecyl ether,
Poly oxyethylene castor oil ether,
Poly oxyethylene cetyl ether,
Poly oxyethylene stearyl ether,
Poly oxyalkylene alkyl ether,
Poly oxyethylene oleate,
Poly oxyethylene nonylphenyl ether,
Sorbitan laurylate,
Sorbitan stearate,
Sorbitan oleate,
Sorbitan trioleate,
Poly oxyethylene sorbitan laurate,
Poly oxyethylene sorbitan strearate,
Poly oxyethylene sorbitan oleate,
Poly oxyethylene sorbitan trioleate,
Poly oxyethylene polystyrenephenyl ether,
Poly ethyleneglycol,
Poly oxyethylene poly oxypropylene ether, and their combination.

The anionic surfactant used in the present invention includes a variety of compounds, and is instanced as soaps of fatty acid metal salts, polycarbonic acid type of polymer surfactants, salts of sulphate esters of alkyl polyethers, ethyleneoxide adducts of higher alcohols, salts of alkylaryl sulfonate, alkyl surfonic acids, aryl sulfonic acids, phosphate esters, aliphatic phosphate esters, aromatic phosphate esters, poly oxyethylene alkyl sulphate esters, dialkyl sulfosuccinate esters, alkylbenzene sulfonate, poly oxyalkylene alkylether phosphate esters, poly oxyalkylene arylether phosphate esters, poly oxyalkylene alkylarylether phosphate esters, and the like, and among them, anionic surfactant having poly oxyethylene group or groups is favorable from point of view of dispersion-stability.

Moreover, with regard to the use of the anionic surfactant having poly oxyethylene group or groups in the present invention, the anionic surfactant is being characterized by having additioned poly oxyethylene group consisting of less than or equal to 15 of oxyethylene units, and the anionic surfactant is being characterized by having a tail-end ether residue selected from a group consisting of alkyl group, alkylphenyl group, phenylxylyl group, stylylphenyl group, and the leuco dye-dispersion liquid containing the surfactant is being characterized by the content ratio of the smallest dye particle ingredient having particle size less than or equal to 0.07 m is less than or equal to one percent, and the leuco dye-dispersion liquid containing the surfactant is being characterized by the content of the surfactant from 5 to 25 weight % for the leuco dye content, and the leuco dye-dispersion liquid containing the surfactant is being characterized by a silicone emulsion ranging from 1 to 10 weight % for the leuco dye contained, thereby excellent thermosensitive recording member is provided which has high sensitivity, high heat-resistivity, excellent brightness of background area.

Especially, with regard to the brightness of background area, it is found out in the present invention that the brightness of background area alters in accordance to the mole number of oxyethylene groups additioned in the surfactant having poly oxyethylene group, there is a tendency that the smaller mole number causes the more brightness of background area, and particularly, in case of the mole number less than or equal to 20 is affected the tendency, and if less than or equal to 15, the tendency is dominant. And an amount less than 5 weight % of anionic surfactant or nonionic surfactant effects no milling in dye particle size, while an amount more than 25 weight % impedes the color-development of image in thermosensitive member, thus lowering the optical density of the colored image and decreasing storage-stability thereof, accordingly, an amount to be used ranging 5 to 25 is a compatible amount with the suppression of undesirable side-effect and achievement of the dispersion stability.

On the other hand, with regard to average size of leuco dye particles, the smaller average size causes the higher sensitivity, however if smaller than 0.1 m the heat-resistivity during storage before recording is declined, thus heat-tinting (fogging) of background area will occur, causing an inconvenience in real use, accordingly, it is favorable to controll the average particle size of leuco dye in the range between 0.1 to 0.3 m to make the heat-resistivity compatible with the higher sensitivity. And when the content ratio of particles having particle size less than 0.07 m increases, tinting (fogging) of background area occurs, the same as the case of average particle size, if the content ratio exceeds one percent, such tendency becomes dominant, therefore a ratio less than or equal to one percent amount is particularly favorable.

The surfactant having poly oxyethylene group used in the present invention is instanced as, but not limited to, compounds represented by General formula (1) and General formula (2).

$$X—O—(—CH_2CH_2O—)n—SO_3—Y \qquad \text{General formula (1)}$$

$$X—O—(—CH_2CH_2O—)n—SO_3—H \qquad \text{General formula (2)}$$

wherein, X is a saturated or unsaturated alkyl group having carbon atoms of 8–20 (e.g., octyl group, lauryl group, tridecyl group, oleyl group, cetyl group, stearyl group), a group selected from octyl-phenyl group, nonyl-phenyl group, stearyl-phenyl group, xylyl-phenyl group, bisxylyl-phenyl group; and trixylyl-phenyl group, or aromatic group (e.g., phenyl group, naphthyl group); Y is Na, $NH_4$, or $N(CH_2—CH_2—OH)_3$; and n is an integer of 60 or less, preferably 20 or less, and more preferably 10 or less. In addition, X can be a mixture of two or three alkyl groups, for example a mixture of alkyl groups having carbon atoms of 12–15 or a mixture of an alkyl group having carbon atoms of 12 and an alkyl group having carbon atoms of 13.

In case of combination use of nonionic surfactant and anionic surfactant in accordance to the present invention, the ratio thereof is favorably ranged from 0.05 to 1 part of the anionic surfactant for one part of the nonionic surfactant.

The polymer dispersant used jointly with the anionic surfactant or/and the nonionic surfactant in accordance to the present invention includes poly vinylalcohol, modified poly vinylalcohol, starch and derivatives therefrom, cellulose derivatives such as hydroxymethyl cellulose, hydroxyethyl cellulose, carboxymethyl cellulose, methyl cellulose, and among them, poly vinyl alcohol acryl sulfonate metal salt is favorable. Further, amount of the polymer dispersant to be used is favorably ranged from 2 to 10% for one part of the leuco dye. The use of amount less than 2% is recognized no improvement in water-proof of image developed, while the use of amount more than 10% makes the dye particles state likely to occur secondary aggregation.

The preparation of dye dispersion liquid of leuco dye having average particle size of 0.10 to 0.30 m by a dispersion process using a dispersion media requires a long time of processing period, and is difficult to set a condition to avoid secondary aggregation of dye particles, therefore have not yet been realized at industrial scale. Dispersion efficiency itself is able to improved using nonionic surfactant or anionic surfactant instead of water-soluble polymer as dispersant, however preparation of 0.10 to 030 m average particle size of leuco dye in dye dispersion liquid is not always good enough by only use of nonionic surfactant or anionic surfactant, particularly in the mass-production of real and industrial scale. Accordingly, the present invention plans to more improve the dispersion efficiency by employing a dispersion media having diameter in the range from 0.8 mm to 0.3 mm. If a dispersion media having diameter more than 0.8 mm is used, the milling of dye for lowering to 0.30 m diameter takes long time of processing period. This is caused by a reason that each dye particles having been milled to one m diameter size decreases the probability to collide with dispersion media, thus dropping the dispersion efficiency significantly. And if a dispersion media having diameter less than 0.3 mm is used, separation of the media used from the resultant dye dispersion liquid becomes difficult, thus decreasing productivity of the dispersion liquid, and as a result of insufficient separation, the media used comes into thermosensitive layer of thermosensitive member, thus injuring thermal head when the thermosensitive member is subjected to recording. Accordingly, a dispersion media having diameter in the range from 0.8 mm to 0.3 mm is favorable.

As mentioned above, from point of view of dispersion efficiency, diameter of media to be used should be determined in accordance to the size of dye particle to be milled, for example, in case of milling a leuco dye having particle size more than or equal to one m, it is favorable to select the diameter of dispersion media to be used in the range from 0.8 mm to 1.0 mm, on the other hand in case of milling a dye having particle size less than one m, it is favorable to select the diameter of dispersion media to be used in the range from 0.8 mm to 1.0 mm. Therefore it is recommendable to execute two steps milling in which first of all to conduct a coarse milling procedure using dispersion media of diameter in the range from 0.8 mm to 1.0 mm, then conduct a fine milling procedure using dispersion media of diameter in the range from 0.3 mm to 0.5 mm.

With regard to material of the media, in general, glassily material is used in the present invention, and in consideration of dispersion efficiency in the present invention, it is favorable to employ media made of zirconia, which has larger specific gravity, and the like, to enhance a collision energy between dye particles and media. Examples of glass media include soda glass(made by Aimex Co. Ltd.), Highbeeds(made by Ashizawa Company) and the like, and examples of zirconia include zirconia bead(made by Nikkato Corp.) and zirconia bead(made by Toray Industries Inc.) and the like.

Foam generated in the dispersion liquid during dispersion process enters into a gap between dye particle and dispersion media, thus interrupts the collision of the dye particle with the dispersion media, decreasing the dispersion efficiency, therefore its removal is favorable for improving the dispersion efficiency. Accordingly, as a defoaming agent, silicon emulsion, mineral oil, acetylene glycohol, higher fatty acid and the like are may used. Especially, silicon emulsion can achieve a high defoaming effect, however no effect is conducted by the dosage amount less than one percent thereof while more than 10% causes the obstruction of color development of thermosensitive member using it, declining optical density of image developed, and decreasing storage stability thereof, hence the dosage amount in the range from 1 to 10% enables the removal of the foam and thus improves dispersion efficiency.

Dispersion apparatuses using media include ball mill, attrition mill, sand mill, SC mill, ring mill, spike mill, co-ball mill, dino mill, and among them, SC mill, ring mill and spike mill have a mechanism capable of generating a strong centrifugal power, therefore they give a large shearing power to the material to be milled, and can shorten the required time of dispersion period(improvement of dispersion efficiency).

The reason why the storage stability is declined by re-use of used pulp, in other words, by using a supporting substrate containing pulp from used paper, has not yet been clarified. However it is believed that the pulp made from used paper contains surfactant which injures the chemical and physical bondings for coloring between leuco dye and acidic material as developer, thereby storage stability of image colored on thermosensitive member is declined, on the other hand, according to the present invention, the contacting probability of leuco dye with developer is increased, and the existent probability of surfactant at contacting site of leuco dye with developer is decreased in concordance with the decrease of particle size of leuco dye, thus compensating the injured bonding for coloring between leuco dye and developer, and decreasing opportunity to exist the surfactant at the contact site, hence an excellent storage stability is attained.

A leuco dye-dispersed liquid according to the present invention is provided in which the average particle diameter of a leuco dye is 0.30 $\mu$m or smaller, a dispersant for dispersing the leuco dye is mainly an anionic surfactant and/or a nonionic surfactant, and the content of particles having a particle diameter of not greater than 0.07 $\mu$m in the leuco dye dispersed liquid is 1.0% or smaller. A resultant thermosensitive recording material of the present invention can thus be improved in the sensitivity and the thermally resistive storage-stability but reduced in the effect of tinting (fogging) of background area.

A leuco dye used in a thermosensitive coloring layer in the present invention may be a single or a mixture of two or more materials. The leuco dye used preferably in the thermosensitive recording material may be selected from various leuco compounds which are also being used in prior arts of the field including, for example, tri-phenylmethanes, fluorans, phenothiazines, auramines, spiramines, and indolyno-phthalide leuco compounds. Characteristic examples of the leuco dye are:

3,3,-bis(p-dimethylaminophenyl)-phthalide,
3,3,-bis(p-dimethylaminophenyl)-6-dimethylamino-phthalide(crystal violet lactone),
3,3,-bis(p-dimethylaminophenyl)-6-diethylamino-phthalide,
3,3,-bis(p-dimethylaminophenyl)-6-chlorphthalide,
3,3,-bis(p-dibutylaminophenyl)-phthalide,
3-cyclohexylamino-6-chlorfluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-{N-(3'-trifluormethylphenyl)amino}-6-diethylamino-fluoran,
2-{3,6-bis(diethylamino)-9-(o-chloranilino)xanthyl lactam-benzoate},
3-diethylamino-6-methyl-7-(m-trichloromethylanilino) fluroran,
3-N-methyl-N,m-amylamino-6-methyl-7-anilinofluoran,
3-N-methyl-N-cyclohexylamino-6-methyl-7-anilinofluoran,
3-(N,N-diethylamino)-5-methyl-7-(N,N-dibenzylamino) fluoran, benzoil leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl) phthalide,
3-(2'-hydroxy-4'-methylaminophenyl)-32'-methoxy-5'-nitrophenyl) phthalide,
3-(2'-hydroxy-4'-diethylaminophenyl)-3-(2'-methoxy-5'-methylphenyl) phthalide,
3-(2'-methoxy-4'-methylaminophenyl)-3-(2'-hydroxy4'-chloro-5'-methylphenyl) phthalide,
3-N-ethyl-N-tetrahydrofrufuryl)amino-6-methyl-7-anilinofluoran,
3-N-ethyl-N-2-ethoxypropyl)amino-6-mehyl-7-anilinofluoran,
3-N-methyl-N-isobutyl-6-methyl-7-anilinofluoran,
3-morpholino-7(N-propyl-trifluoromethylanilino)fluoran,
3-pyrrolidino-7-tifluoromethylanilino-fluoran,
3-diethylamino-5-chloro-7(N-benzyl-trifluoromethyl-anilino)fluoran,
3-pyrrolidino-7-(di-p-chlorphenyl)methylanilino fluoran,
3-diethylamino-5-chloro-7-($\alpha$-phenylethylamino)fluoran,
3-(N-ethyl-p-toluidino)-7-($\alpha$-phenylethylamino)fluoran,
3-diethylamino-7-(o-methoxycarboxyphenylamino)fluoran,
3-diethylamino-5-methyl-7-($\alpha$-phenylethylamino)fluoran,
3-diethylamino-7-piperidino fluoran,
2-chloro-3-(N-methyltoluidono)-7-p-n-butylanilino)fluoran,
3-di-n-butylamino-6-methyl-7-anilino fluoran,
3,6-bis(dimethylamino)fluolenespiro(9,3')-6'-dimethylamino phthalide,
3-(N-benzyl-N-cyclohexylamino)-5,6-benzo-7-$\alpha$-naphthylamono-4'-bromo fluoran, 3-diethylamino-6-methyl-7-mesitydino-4',5'-benzo fluoran,
3-N-methyl-N-isopropyl-6-methyl-7-anilino fluoran,
3-N-ethyl-N-isoamyl-6-methyl-7-anilino fluoran,
3-diethylamino-methyl-7-(2',4'-dimethylanilino) fluoran,
3-morpholino-7-(N-propyl-trifluoromethylanilino) fluoran,
3-pyrrolidino-7-trofluoromethylanilino fluoran,
3-diethylamino-5-chloro-7-(N-benzyl-trifluoromethyl-anilino) fluoran,
3-pyrrolidino-7-(di-p-chlorophenyl) methylamino fluoran,
3-diethylamino-5-chloro-(α-phenylethylamino) fluoran,
3(N-ethyl-p-toluidino)-7-(α-phenylethylamino) fluoran,
3-diethylamino-7(o-methoxycarboxyphenylamino) fluoran,
3-diethylamino-5-methyl-7-(α-phenylethylamino) fluoran,
3-diethylamino-7-piperidino fluoran, 2-chloro-3-(N-metyltoluidino)-7+N-butylanilino) fluoran,
3,6-bis(dimethylamino)fluolenespiro(9,3')-6'-dimethyl-amino phthalide,
3-(N-benzyl-N-chclohexylamino)-5,6-benzo-7-α-naphtylamino-4'-bromo fluoran,
3-diethylamino-6-chloro-7-anilino fluoran,
3-N-ethyl-N-(2-ethoxypropyl)amino-6-methyl-7-anilino fluoran,
3-N-ethyl-N-tetrahydrofurfrylamino-6-methyl-7-anilino fluoran,
3-diethylamino-6-methyl-7-mesitydino-4',5'-benzo fluoran,
3-(p-dimethylaminophenyl)-3-{1,1-bis(p-dimethyl-aminophenyl)ethylene-2-il} phthalide,
3-(p-dimethylaminophenyl)-3-{1,1-bis(p-dimethyl-aminophenyl)ethylene-2-il}-6-dimethyla mino phthalide,
3-(p-dimethylaminophenyl)-3-{1-p-dimethylaminophenyl-1-phenylethylene-2-il} phthalide,
3-(p-dimethylaminophenyl)-3-(1-p-dimethylaminophenyl-1-p-chlorophenylethylene-2-il)-6-dimethylamino-phthalide,
3-(4'-dimethylamino-2'-methoxy)-3-(1"-p-dimethyl-aminophenyl-1"-p-chlorophenyl-1",3"-butadiene-4"-il) benzophthalide,
3-(4'-diethylamino-2'-benzyloxy)-3-(1"-p-diethyl-aminophenyl-1'-phenyl-1",3"-butadiene-4"-il) benzophthalide,
3-dimethylamino-6-dimethylamino-fluolene-9-spiro-3'-(6'-dimethylamino)phthalide,
3,3-bis{2-(p-dimethylaminophenyl)-2-(p-methoxyphenyl) ethenyl}^4,5,6,7-tetrachlorophth alide,
3-bis {1,1-bis(4-pyrrolidinophenyl)ethylene-2-il}-5,6-dichloro-4,7-dibromophthalide,
bis(p-dimethylaminostyryl)-1-naphthalenesulfonylmethane, and
bis(p-dimethylaminostyryl)-1-p-tolylsulfonylmethane.

Characteristic examples of the developer according to the present invention include:
4,4-isopropylidene-bisphenol,
4,4'-isopropylidene-bis(o-methylphenol),
4,4'-sec-butylidene-bisphenol,
4,4'-isopropylidene-bis(2-tert-butylphenol),
4,4'-methylene-bis(oxyethylene-thio)diphenol,
p-nitro zinc benzoate,
1,3,5-tris(4-tert-butyl-3-hydroxy-2,6-dimethylbenzyl) isocyanuric acid,
2,2-(3,4'-dihydroxydiphenyl)propane,
bis(4-hydroxy-3-metylphenyl)sulfide,
4-(β-(p-methoxyphenoxy)ethoxy) salicylic acid,
1,7-bis(4-hydroxyphenyl-thio)-3,5-dioxaheptane,
1,5-bis(4-hydroxyphenyl-thio)-5-oxaheptane,
mono-calcium salt of monobenzyl ester phthalate,
4,4'-cyclohexylidene-diphenol,
4,4'-isopropylidene-bis(2-chlorophenol),
2,2'-methylene-bis(4-methyl-6-tert-butylphenol),
4,4'-butylidene-bis(6-tert-butyl-2-methylphenol),
1,1,3-tris(2-methyl-4-hydroxy-5-tert-butyl)butane,
1,1,3-tris(2-methyl-4-hydroxy-5-cyclohexylphenyl)butane,
4,4'-thiobis(6-tert-butyl-2-methylphenol),
4,4'-diphenol sulfone,
4-isopropoxy-4'-hydroxy-diphenyl sulfone,
4-benzyloxy-4'-hydroxy-diphenyl sulfone,
4,4'-diphenol sulfoxide, p-hydroxy isopropyl benzoate,
p-hydroxy benzyl benzoate,
benzyl protocatechuic acid,
stearyl gallic acid,
lauryl gallic acid,
octyl gallic acid,
1,3-bis(4-hydroxyphenyl-thio)propane,
N,N'-diphenyl-thiourea,
N,N'-di(m-chlorophenyl)thiourea,
salityl anilide,
bis(4-hydroxyphenyl) methyl-ester acetate,
bis(4-hydroxyphenyl) benzyl-ester acetate,
1,3-bis(4-hydrxycumyl) benzene,
1,4-bis(4-hydrxycumyl) benzene,
2,4'-diphenol sulfone,
2,2'-diaryl-4,4'-diphenol sulfone,
3,4-dihydroxyphenyl-4'-methylphenyl sulfone,
1-acetyloxy-2-zinc naphthoate,
2-acetyloxy-1-zinc naphthoate,
3-acetyloxy-3-zinc naphthoate,
α,α-bis(4-hydroxyphenyl)α-methyl-toluene,
antipyrine complex of zinc thiocyanate,
tetra-bromo-bisphenol A,
tetra-bromo-bisphenol S,
4,4'-thiobis(2-methylphenol),
4,4-thiobis(2-chlorophenol),
(poly) 4-hyroxy benzoate derivative (specified in WO99/51444 publication),
urea-urethane compound (specified in WO00/14058 publication),
diphenyl sulfone derivative, and other developers having a sulfonyl-amino group, carbonyl-amide group (specified in Japanese Laid-open Patent Publication of Tokkai Hei 8-333329),
oligomer composition obtained by polycondensation of a polyvalent(more than three or more functionals) isocyanate compound represented by General formula (3) and an aromatic amine represented by General formula (4)

X NCO a — General formula (3)

General formula (4)

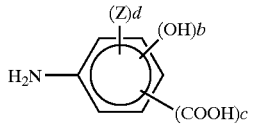

(where the X is a polyvalent group(three- or more-functional), the a is an integer of three or more, the b and the c are, respectively, integers in the scope of zero to five where b+c=a numeral ranging from 0 to 5, the Z represents hydrogen atom(s), alkyl group(s), alkenyl group(s), or aryl group(s), the aryl group(s) may form condensed ring attached thereto, the d is an integer in the scope of zero to four where b+c+d=a numeral ranging from 0 to 5).

The developer is used preferably 2 to 10 parts for one part of the leuco dye. For improving the resistance to other chemicals, the developer may preferably be selected from (poly) 4-hyroxy benzoate derivative, ureaurethane compound, sulfone derivative including 4,4'-dihydroxydiphenyl sulfone, developers having sulfonyl-amino group or carbonyl-amide group, and oligomer composition obtained by polycondensation of polyvalent isocyanate compound and aromatic amine as represented above, while it should be noticed that those each developer shows low sensitivity when used in combination with leuco dye of usual particle size, therefore they have been questioned to real use heretofore, however in the present invention, when they are used in combination with the finely divided leuco dye, an improvement of sensitivity is now achieved, thus they makes actual level of availability.

The average particle size or the average particle diameter in the present invention means average volumetric particle diameter, the average particle diameter and a distribution in particle diameters thereof including the 0.07 $\mu$m or smaller diameter particles of the leuco dye can be measured by Laser analysis/scattering method(using a Micro-Track HRA 9320-X100 model, a Horiba LA920 model made by HORIBA LTD, or a Lasentech FBRM model). Also, a centrifugal precipitation method, a Courter counter, electron microscope and, or other known devices used usually for the purpose of such kind of analysis may be used with equal success.

A sensitizer to bbe used in combination with the dye and the developer may be further added for increasing the sensitivity.

Characteristic examples of the sensitizer according to the present invention are:

fatty acid such as stearic acid or behenic acid, fatty acid amide such as stearic acid amide or palmitic acid amide; fatty acid metal salt such as zinc stearate, aluminum stearate, calcium stearate, zinc palmitate, or zinc behenate; p-benzylbiphenyl; terphenyl; triphenyl; benzyl p-benzyloxybenzoate; β-benzyloxy naphthalene; phenyl β-naphthoate; 1-hydroxy-2-phenyl naphthoate, 1-hydroxy-2-methyl naphthoate, diphenyl carbonate, glarecoal carbonate, dibenzyl terephthalate, 1,4-dimethoxy naphthalene, 1,4-diethoxy naphthalene, 1,4-dibenziroxy naphthalene, 1,2-diphenoxy ethane, 1,2-bis(3-methylphenoxy) ethane, 1,2-bis(4-methylphenoxy) ethane, 1,4-diphenoxy-2-butene, 1,2-bis(4-mthoxyphenylthio) ethane, dibenxoyl methane, 4-diphenylthiobutane, 1,4-diphenylthio-2-butene, 1,3-bis(2-vinyloxyethoxy) benzene, 1,4-bis(2-vinyloxyethoxy) benzene, p-(2-vinyloxyethoxy) biphenyl, p-allyloxybiphenyl, p-propargyloxybiphenyl, dibenzoyloxy methane, dibenxoyloxy propane, dibenzyl disulfide, 1,1-diphenyl ethanol, 1,1-diphenyl propanol, p-benzyloxybenzyl alcohol, 1,3-phenoxy-2-propanol, N-octadecylcarbamoyl-p-methoxycarbonyl benzene-octadecylcarbamoyl benzene, 1,2-bis(4-methoxyphenoxy) propane, 1,5-bis(4-methoxyphenoxy)-3-oxapantane, dibenzyl oxalate, bis (4-methylbenzyl) oxalate, bis(4-chlorobenzyl) oxalate and other known sensitizer.

Thermosensitive recording material of the present invention may also be added with a binder or any other appropriate additive for favorably bonding onto a supporting substrate.

Characteristic examples of the binder are: water-soluble polymers including polyvinyl alcohol, starch and derivative thereof cellulose derivative such as hydroxy methyl cellulose, hydroxy ethyl cellulose, carboxy methyl cellulose, methyl cellulose, or ethyl cellulose, poly acrylic acid sodium salt, polyvinyl pyrrolidone, acrylamide/acrylic acid ester copolymer, acrylamide/acrylic acid ester/methacrylate terpolymer, styrene/maleic acid anhydride copolymer, alkali metal salt of isobutylene/maleic acid anhydride copolymer, polyacrylamide, alginic acid sodium salt, gelatin, and casein; emulsions including polyvinylacetate, polyurethane, polyacrylic acid, poly acrylic acid ester, vinyl chloride/vinyl acetate copolymer, poly butylmethacrylate, and ethylene/vinyl acetate copolymer; and latex including styrene/butadiene copolymer, and styrene/butadiene/acryl resin terpolymer.

Also, as filler may be added such as diatomite, talc, kaolin, calcinated kaolin, calcium carbonate, magnesium carbonate, titanium oxide, zinc oxide, silicon oxide, or aluminum oxide. In addition, a cross-linking agent(curing agent) may be used with equal success.

Supporting substrate used in the present invention is selected from a wood free paper, a paper containing pulp recovered from used paper(containing more than 50% of the pulp recovered), synthetic paper, laminated paper, resinous film and the like. Also, there may be provided an undercoat layer between the supporting substrate base and the thermosensitive recording layer or an overcoat layer onto the thermosensitive recording layer. The undercoat layer and the overcoat layer are made from appropriate materials which include binder, filler, and cross-linking agent described above. When the undercoat layer contains preferably hollow resin particles(small balloons) as the filler, the sensitivity of thermosensitive member prepared will be increased by heat insulating property of the filler.

The hollow resin particles used in the present invention are of small balloons having been foamed, and each particle consists of a shell of thermoplastic resin and an inside cavity containing air or other gases, the average particle size ranging from 2 to 10 m is favorable. If the average particle size of the hollow resin particles is smaller than 2 m, it encounters to difficulties upon production, for example an appropriate volume ratio of inside cavity is hardly achieved and so on, on the other hand the average particle size larger than 10 m decreases the surface-smoothness of thermosensitive material obtained after coating and drying of the liquid to be coated, thus declines the contacting ability of the surface with thermalhead used for executing a recording procedure, hence suppressing the improvement effect of the sensitivity. Accordingly, as size-distribution of the hollow resin particles, favorable is one having not only the average size ranging in the scope above described, but also narrow distribution in size dispersion. The favorable hollow resin particles in the present invention are those having a ratio of hollow(cavity) more than or equal to 50, and more than or equal to 70% is more favorable. The ratio of hollow(cavity) in the present invention means the ratio of inner diameter for outer diameter of the particle, and is represented by following Equation $$\text{The ratio of hollow(cavity)}=[(\text{inner diameter of a particle})/(\text{outer diameter of the particle})]\times 100$$

The hollow resin particles used in the present invention are, as already described above, those having a shell of thermoplastic resin, the thermoplastic resin favorably includes poly stylene, poly vinyl chroride, poly vinylidene chrodide, poly acetic acid, poly acrylic acid ester, poly acrylonitrile, poly buthadiene, isobonyl acrylate, acrylontrile/methacrylonitrile copolymer, In general, the hollow resin particles are used as intermediate layer lied between the thermosensitive coloring layer and supporting substrate, thereby shows an elevated heat-insulating property and excellent contacting ability with thermalhead.

A scheme of recording on the thermosensitive recording material of the present invention may be implemented by, but not limited to, thermal pen, thermal head, or laser heating.

The present invention will be described in more detail in the form of examples. All parts and percentages are by weight throughout the description. The diameter of particles is measured with a Horiba LA-920 model by HORIBA LTD.

(1) [Preparation of Liquid H (dye dispersion liquid)]

Compositions consisting of 30 parts of 3-dibuthyamio-6-methyl-N-7 amino fluoran and solutions of nonionic surfctants(dye content ratio is 30%) were milled using a sand mill to obtain dye dispersion liquids shown Table 1.

TABLE 1

| | nonionic surfactant | | additive | | average particle size | amount of particles of size 0.07 | milling time for arriving to average |
|---|---|---|---|---|---|---|---|
| | type | parts | type | parts | (μm) | μm or less | size(Hs) |
| H-1 | polyoxyethylene-2-ethylhexylether | 3.0 | — | — | 0.28 | 0.78% | 18 |
| H-2 | polyoxyethylene-castor oil-ether | 5.0 | — | — | 0.15 | 0.95% | 16 |
| H-3 | polyoxyethylene-oleate | 4.0 | polyvinyl alcohol | 1.5 | 0.26 | 0.28% | 17 |
| H-4 | polyoxyethylene-sorbitan-laurate | 4.5 | formalin naphthalele sulfonate condensation Na salt | 0.5 | 0.14 | 0.30% | 16 |
| H-5 | polyoxyethylene-stylyl phenyl ether | 5.0 | — | — | 0.17 | 0.50% | 14 |
| H-6 | polyoxyethylene-xylyl phenyl ether | 5.0 | — | — | 0.16 | 0.60% | 13 |
| H-7 | — | — | polyvinyl alcohol | 3.0 | 0.85 | 0.30% | 18 |
| H-8 | — | — | polyvinyl alcohol | 5.5 | 0.22 | 1.30% | 30 |

From a result shown Table I, it became obvious by the present invention that a leuco dye dispersion liquid using a specific nonionic surfactant is able to be prepared with the state having average particle size from 0.10 to 0.30 m, and content ratio of 1.0 percent or less of smaller particle size less than 0.07 m.

(2) [Preparation of Liquid C (developer dispersion liquid)]

(2)1

A composition consisting mainly of 20 parts of 4-isopropoxy-4'-hydroxydiphenyl sulfone, 20 parts of 10% polyvinyl alcohol water solution, and 60 parts of water was milled with a sand mill to disperse a liquid having an average particle diameter of 0.81 μm.

(2)-2

The same process as that of (2)-1, except that 4-hydroxybenzoate polyester (K-5 of Asahi Denka Kogyo K.K) was used instead of 4-isopropoxy4'-hydroxydiphenyl sulfone, was carried out to prepare a dispersion liquid having an average particle diameter of 0.95 μm.

(2)-3

The same process as that of (2)-i, except that an urethane urea compound (UD of Asahi Denka Kogyo K.K) was used instead of 4-isopropoxy4'-hydroxydiphenyl sulfone, was carried out to prepare a dispersion liquid having an average particle diameter of 0.78 μm.

(2)-4

The same process as that of (2)-i, except that a derivative of diphenyl sulfonic acid (D-90 of Nippon Soda Co. Ltd.) was used instead of 4 isopropoxy4'-hydroxydiphenyl sulfone, was carried out to prepare a dispersion liquid having an average particle diameter of 0.72 um.

(2)-5

The same process as that of (2)-1, except that a compound having a sulfonylaminocarbonylamide group (Pergafast 201 of Chibae Specialty Chemicals Ltd.) was used instead of 4-isopropoxy4'-hydroxydiphenyl sulfone, was carried out to prepare a dispersion liquid having an average particle diameter of 0.88 μm.

(2)-6

The same process as that of (2)-1, except that 4,4'-dihydorxy diphenyl sulfone(Bisphenol S) was used instead of 4-isopropoxy-4'-hydroxydiphenyl sulfone, was carried out to prepare a dispersion liquid having an average particle diameter of 0.88 μm.

(2)-7

The same process as that of (2)-1, except that an oligomer made from 1,3,5-tris(6-isocyanatehexyl)-1,3,5-triazine-2,4,6-(1H, 3H, 5H)-tri on and 4-amino salicylic acid was used instead of 4-isopropoxy4'-hydroxydiphenyl sulfone, was carried out to prepare a dispersion liquid having an average particle diameter of 0.88 μm.

(3) [Preparation of Coating Liquid For Thermosensitive Coloring Layer]

20 parts of dye dispersion liquids(liquid H), 60 parts of developer dispersion liquid(liquid C), 10 parts of colloidal silica (20% solid), 20 parts of styrene butadiene latex (50% solid), 15 parts of dispersion liquid dispersing stearic acid amide (20% solid), and 1 part of water solution of dioctylsulfo-succinic acid (5% solid) were mixed to prepare a coating liquid for making the thermosensitive coloring layer.

(4) [Preparation of Liquids For Forming Undercoating Layer] (4)-1

A mixture of 20 parts of calcined kaolin, 20 parts of styrene/butadiene copolymer latex (47.5% solid), and 60 parts of water was dispersed to prepare a liquid for forming undercoat layer.

(4)-2

A mixture of 25 parts of hollow resin particle (90% hollow rate, 3.5 μm average particle diameter, 40% solid), 15 parts of styrene/butadiene copolymer latex (47.5% solid), and 60 parts of water was dispersed to prepare a liquid for forming undercoat layer.

(5) [Preparation of Liquid For Overcoat Layer]

A mixture of 20 parts of aluminum hydroxide, 20 parts of 10% polyvinyl alcohol water solution, and 60 parts of water were dispersed using a ball mill for 24 hours to prepare a liquid for over coating layer.

(Preparation of Thermosensitive Recording Member Sheets)

A sheet of 60 g/m$^2$ thickness of wood free paper was coated with a liquid for forming undercoat layer shown in Table 2, and dried to prepare 3.0 g/m$^2$ thickness of layer at dried state and. Next, thereon was coated with coating liquids prepared by using dye dispersion liquids and developer dispersion liquids shown Table 2, and dried to prerare thermosensitive layers of 0.45 g/m$^2$ thickness at dried state, then the thermosensitive layers were coated with a resinous solution to provide resin layer having 1.5 g/m$^2$ thickness at dried state, then the thermosensitive members prepared were super-calendered.

(Evaluation Tests)

(Increased Ratio of Sensitivity)

Using a thermal print testing machine with a thinfilm thermal head made by Matsushita Electric Component Ltd., the calendered thermosensitive members were, under the conditions of electric power imposed the thermalhead of 0.45 W/ one dot, recording time of 20 m sec. for one line, and scanning resolution of 8×385 dots/mm, printings with pulse width of 0.0 to 0.7 mmsec at intervals of 1 msec, recorded(partially colored) to print images, and the images colored on the thermosensitive members were measured their optical densities using a Macbeth densitometer RD-914, the measured resultants were calculated to detemine a pulse width required for obtaining optical density 1.0 of colored image.

The sensitivity is calculated, in comparison with Comparison 1 as the standard, by a calculation formula of; Improved Ratio of Sensitivity=(pulse width of Comparison 1)/(pulse width of sample subject). The greater of the result shows the higher sensitivity (the thermal response).

(Image Density)

Using the same thermal print testing machine, the calendered thermosensitive members were recorded(colored) at a pulse width of 0.5 mm sec. The optical density of a resultant images and background areas thereon were measured with using the Macbeth densitometer RD-914.

(Resistance to Heat)

The recorded samples produced under the above conditions were left at 80° C. for 15 hours and optical densities of images and background areas thereon were examined.

(Plasticizer Resistance)

The recorded samples produced under the above conditions were coated with dibutyl-terephthalate, left at 40° C. for 72 hours, and measured for optical densities of images thereon. A result is expressed by (optical density after test)/(original density)×(100)(%).

TABLE 2

| | | dye | developer | | before test density | | after heat resistance test | | plasticizer heat |
|---|---|---|---|---|---|---|---|---|---|
| | undercoat | dispersion liquid | dispersion liquid | sensitivity (times) | image density | background density | image density | background density | resistive (%) |
| Ex. 1 | (4)-1 | (H)-1 | (2)-1 | 1.15 | 1.41 | 0.05 | 1.42 | 0.16 | 64 |
| Ex. 2 | (4)-1 | (H)-2 | (2)-1 | 1.18 | 1.42 | 0.05 | 1.43 | 0.17 | 66 |
| Ex. 3 | (4)-1 | (H)-3 | (2)-1 | 1.16 | 1.40 | 0.06 | 1.42 | 0.13 | 66 |
| Ex. 4 | (4)-1 | (H)-4 | (2)-1 | 1.21 | 1.44 | 0.05 | 1.45 | 0.14 | 65 |
| Ex. 5 | (4)-2 | (H)-1 | (2)-1 | 1.42 | 1.42 | 0.05 | 1.44 | 0.15 | 64 |
| Ex. 6 | (4)-1 | (H)-1 | (2)-2 | 1.05 | 1.35 | 0.05 | 1.37 | 0.16 | 92 |
| Ex. 7 | (4)-1 | (H)-1 | (2)-3 | 1.03 | 1.37 | 0.06 | 1.38 | 0.17 | 91 |
| Ex. 8 | (4)-1 | (H)-1 | (2)-4 | 1.10 | 1.38 | 0.05 | 1.40 | 0.15 | 97 |
| Ex. 9 | (4)-1 | (H)-1 | (2)-5 | 1.10 | 1.38 | 0.05 | 1.40 | 0.15 | 89 |
| Com. Ex. 1 | (4)-1 | (H)-7 | (2)-1 | 1.00 | 1.32 | 0.09 | 1.34 | 0.18 | 63 |
| Com. Ex. 2 | (4)-1 | (H)-8 | (2)-1 | 1.17 | 1.33 | 0.16 | 1.36 | 0.38 | 65 |
| Com. Ex. 3 | (4)-1 | (H)-7 | (2)-2 | 0.63 | 1.23 | 0.06 | 1.27 | 0.14 | 91 |
| Com. Ex. 4 | (4)-1 | (H)-7 | (2)-3 | 0.65 | 1.22 | 0.06 | 1.25 | 0.16 | 89 |
| Com. Ex. 5 | (4)-1 | (H)-7 | (2)-4 | 0.70 | 1.28 | 0.05 | 1.31 | 0.13 | 96 |
| Com. Ex. 6 | (4)-1 | (H)-7 | (2)-5 | 0.69 | 1.27 | 0.06 | 1.30 | 0.15 | 86 |

From above results, it is understood that the thermosensitive material of the present invention shows a high optical density of image colored(developed), a high sensitivity, a few tinting(fogging) in background area, an excellent resistance for heat storage, an excellent proof for influence of plasticizer.

Furthermore, liquid A and Liquid B were prerared.

(6) [preparation of liquid A, Liquid B(dye dispersion liquids)]

Compositions(30% of leuco dye content) consisting of 30 part of 3-dibuthylamino-6-methyl-N-7-anilino fluoran, surfactants shown in Table 3, silicon emulsion in amounts shown in Table 3, polymer dispersant were milled under the dispersing conditions shown in Table 3 to prepare leuco dye dispersion, using a sand mill(DYNOMILL Type KDL Pilot by Backkerfuen), a SC mill(SC-100 Model by MITSUI MINING COMPANY LIMITED),a ring mill(SRG-100 by ARAKI Iron and Steel), and a spike mill(SHG-4 by INOUE Manufacturing).

TABLE 3

| | surfactant | | | | silicon emulsion | polymer dispersant | | dispersing conditions | | | average | milling time for arriving | ratio of smaller particles less | fogging |
|---|---|---|---|---|---|---|---|---|---|---|---|---|---|---|
| | X | n | Y | added amount (parts) | added amount (parts) | name | added amount (parts) | used media | media size (mm) | dispersing apparatus | particle size. (μm) | to average size(Hs) | than 0.07 μm size | state of liquid |
| A-1 | lauryl group | 3 | Na | 5 | 0.3 | — | — | glass | 0.8 | sand mill | 0.20 | 18 | 0.0 | |
| A-2 | lauryl group | 3 | Na | 5 | 0.3 | — | — | glass | 0.4 | sand mill | 0.20 | 12 | 0.0 | |
| A-3 | stylylphenyl group | 6 | Na | 5 | 0.3 | — | — | zirconia | 0.4 | sand mill | 0.15 | 9 | 0.2 | |
| A-4 | stylylphenyl group | 6 | Na | 5 | 1 | — | — | zirconia | 0.4 | sand mill | 0.14 | 8 | 0.2 | |
| A-5 | stylylphenyl group | 6 | Na | 5 | 1 | — | — | glass, zirconia | 1.0 0.4 | sand mill | 0.12 | 7 | 0.0 | |
| A-6 | lauryl group | 3 | Na | 10 | 0.3 | — | — | glass | 0.4 | sand mill | 0.20 | 12 | 0.0 | |
| A-7 | lauryl group | 3 | Na | 6 | 0.9 | — | — | glass | 0.8 | sand mill | 0.16 | 17 | 0.1 | |
| A-8 | $C_{12}$, $C_{13}$ alkyl groups | 2 | Na | 6 | 0.9 | — | — | glass | 0.8 | sand mill | 0.15 | 18 | 0.0 | |
| A-9 | $C_{12}$, $C_{13}$ alkyl groups | 3 | $NH_4$ | 6 | 0.9 | — | — | glass | 0.8 | sand mill | 0.17 | 17 | 0.0 | |
| A-10 | lauryl group | 2 | tri-ethanol-amine | 6 | 0.9 | — | — | glass | 0.8 | sand mill | 0.15 | 18 | 0.2 | |
| A-11 | lauryl group | 2 | $NH_4$ | 6 | 0.9 | — | — | glass | 0.8 | sand mill | 0.15 | 17 | 0.0 | |
| A-12 | $C_{12}$, $C_{13}$ alkyl groups | 6 | Na | 6 | 0.9 | — | — | glass | 0.8 | sand mill | 0.17 | 16 | 0.0 | |
| A-13 | $C_{12}$, $C_{13}$ alkyl groups | 8 | $NH_4$ | 7.5 | 0.9 | — | — | glass | 0.8 | sand mill | 0.15 | 18 | 0.0 | |
| A-14 | $C_{12}$ to $C_{15}$ alkyl groups | 3 | $NH_4$ | 6 | 0.9 | — | — | glass | 0.8 | sand mill | 0.16 | 18 | 0.0 | |
| A-15 | nonyl phenyl group | 4 | $NH_4$ | 6 | 0.9 | — | — | glass | 0.8 | sand mill | 0.16 | 18 | 0.0 | |
| A-16 | nonyl phenyl group | 6 | Na | 6 | 0.9 | — | — | glass | 0.8 | sand mill | 0.16 | 17 | 0.0 | |
| A-17 | stylylphenyl group | 6 | $NH_4$ | 6 | 0.9 | — | — | glass | 0.8 | sand mill | 0.14 | 18 | 0.3 | |
| A-18 | stylylphenyl group | 10 | $NH_4$ | 6 | 0.9 | — | — | glass | 0.8 | sand mill | 0.15 | 17 | 0.2 | |
| A-19 | stylylphenyl group | 15 | $NH_4$ | 6 | 0.9 | — | — | glass | 0.8 | sand mill | 0.15 | 17 | 0.2 | |
| A-20 | lauryl group | 15 | Na | 6 | 0.9 | — | — | glass | 0.8 | sand mill | 0.16 | 17 | 0.1 | |
| A-21 | $C_{12}$, $C_{13}$ alkyl groups | 15 | $NH_4$ | 6 | 0.9 | — | — | glass | 0.8 | sand mill | 0.17 | 17 | 0.0 | |
| A-22 | nonyl phenyl group | 15 | $NH_4$ | 6 | 0.9 | — | — | glass | 0.8 | sand mill | 0.16 | 18 | 0.0 | |
| A-23 | phenyl xylyl group | 15 | $NH_4$ | 6 | 0.9 | — | — | glass | 0.8 | sand mill | 0.16 | 18 | 0.0 | |
| A-24 | stylylphenyl group | 6 | $NH_4$ | 4.8 | 0.9 | GOUSELAN L3266 by The Nippon Synthetic Chemical Industry Co. Ltd., | 1.2 | glass | 0.8 | sand mill | 0.17 | 17 | 0.2 | |
| A-25 | stylylphenyl group | 10 | $NH_4$ | 6 | 0.9 | GOUSELAN L3266 by The Nippon Synthetic Chemical Industry Co. Ltd., | 1.2 | glass | 0.8 | sand mill | 0.18 | 16 | 0.3 | |
| A-26 | stylylphenyl group | 6 | $NH_4$ | 4.8 | 0.9 | POBAL 203 by KURARAY Co. Ltd., | 1.2 | glass | 0.8 | sand mill | 0.18 | 15 | 0.2 | |
| A-27 | stylylphenyl group | 10 | $NH_4$ | 6 | 0.9 | POBAL 203 by KURARAY Co. Ltd., | 1.2 | glass | 0.8 | sand mill | 0.17 | 17 | 0.5 | |
| A-28 | phenyl xylyl group | 6 | $NH_4$ | 6 | 0.9 | — | — | glass | 0.8 | sand mill | 0.14 | 18 | 0.3 | |
| A-29 | phenyl xylyl group | 10 | $NH_4$ | 6 | 0.9 | — | — | glass | 0.8 | sand mill | 0.15 | 17 | 0.2 | |
| A-30 | stylylphenyl group | 6 | $NH_4$ | 6 | 0.9 | — | — | zirconia | 0.4 | SC mill | 0.14 | 2 | 0.2 | |

TABLE 3-continued

| | surfactant | | | | silicon emulsion | polymer dispersant | | dispersing conditions | | | average | milling time for arriving | ratio of smaller particles less | fogging |
|---|---|---|---|---|---|---|---|---|---|---|---|---|---|---|
| | X | n | Y | added amount (parts) | added amount (parts) | name | added amount (parts) | used media | media size (mm) | dispersing apparatus | particle size. (μm) | to average size(Hs) | than 0.07 μm size | state of liquid |
| A-31 | lauryl group | 3 | $NH_4$ | 6 | 0.9 | — | — | zirconia | 0.4 | SC mill | 0.20 | 2 | 0.0 | |
| A-32 | $C_{12}$, $C_{13}$ alkyl groups | 8 | $NH_4$ | 7.5 | 0.9 | — | — | zirconia | 0.4 | SC mill | 0.15 | 2.5 | 0.0 | |
| A-33 | stylylphenyl group | 6 | $NH_4$ | 4.8 | 0.9 | GOUSELAN L3266 by The Nippon Synthetic Chemical Industry Co. Ltd., | 1.2 | zirconia | 0.4 | SC mill | 0.17 | 2 | 0.2 | |
| A-34 | stylylphenyl group | 6 | $NH_4$ | 6 | 0.9 | — | — | zirconia | 0.4 | ring mill | 0.14 | 2 | 0.2 | |
| A-35 | lauryl group | 3 | $NH_4$ | 6 | 0.9 | — | — | zirconia | 0.4 | ring mill | 0.20 | 2 | 0.0 | |
| A-36 | $C_{12}$, $C_{13}$ alkyl groups | 8 | $NH_4$ | 7.5 | 0.9 | — | — | zirconia | 0.4 | ring mill | 0.15 | 2.5 | 0.0 | |
| A-37 | stylylphenyl group | 6 | $NH_4$ | 4.8 | 0.9 | GOUSELAN L3266 by The Nippon Synthetic Chemical Industry Co. Ltd., | 1.2 | zirconia | 0.4 | ring mill | 0.17 | 2 | 0.2 | |
| A-38 | stylylphenyl group | 6 | $NH_4$ | 6 | 0.9 | — | — | zirconia | 0.4 | spike mill | 0.14 | 2 | 0.2 | |
| A-39 | lauryl group | 3 | $NH_4$ | 6 | 0.9 | — | — | zirconia | 0.4 | spike mill | 0.20 | 2 | 0.0 | |
| A-40 | $C_{12}$, $C_{13}$ alkyl groups | 8 | $NH_4$ | 7.5 | 0.9 | — | — | zirconia | 0.4 | spike mill | 0.15 | 2.5 | 0.0 | |
| A-41 | stylylphenyl group | 6 | $NH_4$ | 4.8 | 0.9 | GOUSELAN L3266 by The Nippon Synthetic Chemical Industry Co. Ltd., | 1.2 | zirconia | 0.4 | spike mill | 0.17 | 2 | 0.2 | |
| B-1 | — | — | — | — | — | PVA-318 by KURARAY Co. Ltd., | 5 | glass | 0.8 | sand mill | 0.85 | 18 | 0.00 | |
| B-2 | — | — | — | — | — | PVA-318 by KURARAY Co. Ltd., | 5 | glass | 0.8 | sand mill | 0.40 | 30 | 0.10 | X |
| B-3 | — | — | — | — | — | PVA-318 by KURARAY Co. Ltd., | 5 | zirconia | 0.8 | sand mill | 0.30 aggregation | 30 | 0.10 | X |
| B-4 | lauryl group | 3 | Na | 1 | 0.9 | — | — | glass | 0.8 | sand mill | 0.40 aggregation | 12 | 0.10 | |
| B-5 | nonyl phenyl group | 60 | Na | 6 | 0.9 | — | — | glass | 0.8 | sand mill | 0.17 | 17 | 0.1 | |
| B-6 | nonyl phenyl group | 80 | Na | 6 | 0.9 | — | — | glass | 0.8 | sand mill | 0.17 | 17 | 0.0 | |
| B-7 | $C_{12}$, $C_{13}$ alkyl groups | 60 | Na | 6 | 0.9 | — | — | glass | 0.8 | sand mill | 0.16 | 18 | 0.0 | |
| B-8 | stylylphenyl group | 30 | $NH_4$ | 6 | 0.9 | — | — | glass | 0.8 | sand mill | 0.16 | 18 | 0.1 | |
| B-9 | stylylphenyl group | 6 | $NH_4$ | 1.2 | 0.9 | — | — | glass | 0.8 | sand mill | 0.35 aggregation | 15 | 0.0 | |
| B-10 | stylylphenyl group | 6 | $NH_4$ | 9 | 0.9 | — | — | glass | 0.8 | sand mill | 0.17 | 16 | 0.4 | |
| B-11 | stylylphenyl group | 6 | $NH_4$ | 6 | 0 | — | — | glass | 0.8 | sand mill | 0.35 aggregation | 25 | 0.2 | |
| B-12 | stylylphenyl group | 6 | $NH_4$ | 6 | 3.6 | — | — | glass | 0.8 | sand mill | 0.18 | 18 | 0.2 | |
| B-13 | stylylphenyl group | 6 | $NH_4$ | 6 | 0.9 | — | — | glass | 0.8 | sand mill | 0.09 | 25 | 8.5 | X |
| B-14 | lauryl group | 3 | $NH_4$ | 6 | 0.9 | — | — | glass | 0.8 | sand mill | 0.09 | 28 | 10.2 | X |
| B-15 | $C_{12}$, $C_{13}$ alkyl groups | 8 | $NH_4$ | 7.5 | 0.9 | — | — | glass | 0.8 | sand mill | 0.08 | 29 | 9.5 | X |

TABLE 3-continued

| | surfactant | | | | silicon emulsion | polymer dispersant | | dispersing conditions | | | average | milling time for arriving | ratio of smaller particles less | fogging |
|---|---|---|---|---|---|---|---|---|---|---|---|---|---|---|
| | X | n | Y | added amount (parts) | added amount (parts) | name | added amount (parts) | used media | media size (mm) | dispersing apparatus | particle size. (μm) | to average size(Hs) | than 0.07 μm size | state of liquid |
| B-16 | stylylphenyl group | 6 | $NH_4$ | 4.8 | 0.9 | GOUSELAN L3266 by The Nippon Synthetic Chemical Industry Co. Ltd., | 1.2 | glass | 0.8 | sand mill | 0.09 | 27 | 7.6 | X |
| B-17 | stylylphenyl group | 6 | $NH_4$ | 6 | 0.9 | — | — | stainless steel | 2.0 | sand mill | 0.18 | 30 | 0.6 | X |

Evaluation results to study fogged(tinted) state of the liquids, in comparison with dispersion B-1 which was a standard, are represented in Table 3 where the mark xmeans bigger fogging than dispersion B-1, the mark means smaller fogging than dispersion B-1, the mark means slightly fogging the mark means no trace of fogging.

From above result, it is understood that, by satisfying average particle size ranges from 0.10 to 0.30 m and limited amount less than one percent of particle having very small size of less than 0.07 m diameter, the liquid for thermosensitive materials of the present invention produces a dye dispersion liquid which shows an improvement in anti-fogging with high productivity.

Furthermore, a sheet of 60 g/m$^2$ thickness of wood free paper was coated with a liquid for forming undercoat layer shown in Table 4 to prepare 3.0 g/m$^2$ thickness of layer at dried state and dried. Next, thereon was coated with coating liquids prepared by using dye dispersion liquids and developer dispersion liquids shown Table 2, and dried to prerare thermosensitive layers of 0.45 g/m$^2$ thickness at dried state, then the thermosensitive layers were coated with resinous solution to provide resin layer having 1.5 g/m$^2$ thickness at dried state, then the thermosensitive members prepared were super-calendered.

TABLE 4

| | supporting substrate | undercoat layer | dye-dispersion liquid | developer dispersion liquid |
|---|---|---|---|---|
| Ex. 1 | wood free | (4)-1 | A-2 | (2)-1 |
| Ex. 2 | paper | (4)-1 | A-5 | (2)-1 |
| Ex. 3 | LBKP 80% | (4)-2 | A-5 | (2)-1 |
| Ex. 4 | NBKP 20% | (4)-2 | A-5 | (2)-2 |
| Ex. 5 | | (4)-2 | A-5 | (2)-3 |
| Ex. 6 | | (4)-2 | A-5 | (2)-4 |
| Ex. 7 | | (4)-2 | A-5 | (2)-5 |
| Ex. 8 | | (4)-2 | A-5 | (2)-6 |
| Ex. 9 | | (4)-2 | A-6 | (2)-1 |
| Ex. 10 | | (4)-2 | A-6 | (2)-7 |
| Ex. 11 | pulp from used paper 50% NBKP 50% | (4)-2 | A-5 | (2)-4 |
| Com. Ex. 1 | wood free | (4)-1 | B-1 | (2)-1 |
| Com. Ex. 2 | paper | (4)-1 | B-2 | (2)-1 |
| Com. Ex. 3 | LBKP 80% | (4)-2 | B-1 | (2)-1 |
| Com. Ex. 4 | NBKP 20% | (4)-2 | B-1 | (2)-2 |
| Com. Ex. 5 | | (4)-2 | B-1 | (2)-3 |
| Com. Ex. 6 | | (4)-2 | B-1 | (2)-4 |

TABLE 4-continued

| | supporting substrate | undercoat layer | dye-dispersion liquid | developer dispersion liquid |
|---|---|---|---|---|
| Com. Ex. 7 | | (4)-2 | B-1 | (2)-5 |
| Com. Ex. 8 | | (4)-2 | B-1 | (2)-6 |
| Com. Ex. 9 | pulp from used paper 50% NBKP 50% | (4)-2 | B-1 | (2)-4 |

Thus prepared thermosensitive members were evaluated as below. (Evaluation Tests)

(Ratio of Sensitivity)

Using a thermal print testing machine with a thinfilm thermal head made by Matsushita Electric Component Ltd., the calendered thermosensitive members were, under the conditions of electric power imposed the thermalhead of 0.45 W/ one dot, recording time of 20 m sec. for one line, and scanning resolution of 8×385 dots/mm, printings with pulse width of 0.0 to 0.7 mmsec at intervals of 1 msec, colored(recorded) to print images, and the images colored on the thermosensitive members were measured their optical densities using a Macbeth densitometer RD-914, the measured resultants were calculated to detemine a pulse width required for obtaining optical density 1.0 of colored image.

The sensitivity is calculated, in comparison with Comparison 1 as the standard, by a calculation formula of; Improved Ratio of Sensitivity=(pulse width of Comparison 1)/(pulse width of sample subject). The greater of the result shows the higher sensitivity (the thermal response). Resuts were shown in Table 5.

(Image Density)

Using the same thermal print testing machine, the calendered thermosensitive members were colored(recorded) at a pulse width of 0.5 mm sec. The optical density of a resultant images and background areas thereon were measured with using the Macbeth densitometer RD-914.

(Resistance to Heat)

The recorded samples produced under the above conditions were left at 80° C. for 15 hours and optical densities of images and background areas thereon were examined.

(Resistance to Humid and Heat

The recorded samples produced under the above conditions were left at 40° C., 90% of relative humidity for 15 hours and optical densities of images and background areas thereon were examined.

TABLE 5

| | sensitivity | before test density | | after heat resistance test | | after heat & humidity proof test | |
|---|---|---|---|---|---|---|---|
| | (times) | image | background area | image | background area | image | background area |
| Ex. 1 | 1.20 | 1.38 | 0.07 | 1.39 | 0.16 | 1.37 | 0.11 |
| Ex. 2 | 1.25 | 1.38 | 0.07 | 1.38 | 0.17 | 1.37 | 0.11 |
| Ex. 3 | 1.50 | 1.39 | 0.07 | 1.38 | 0.17 | 1.38 | 0.11 |
| Ex. 4 | 1.05 | 1.35 | 0.07 | 1.36 | 0.13 | 1.34 | 0.10 |
| Ex. 5 | 1.03 | 1.33 | 0.08 | 1.35 | 0.14 | 1.32 | 0.10 |
| Ex. 6 | 1.10 | 1.33 | 0.07 | 1.35 | 0.09 | 1.32 | 0.07 |
| Ex. 7 | 1.15 | 1.38 | 0.07 | 1.37 | 0.09 | 1.36 | 0.07 |
| Ex. 8 | 1.10 | 1.35 | 0.08 | 1.35 | 0.13 | 1.34 | 0.10 |
| Ex. 9 | 1.42 | 1.33 | 0.09 | 1.29 | 0.17 | 1.32 | 0.11 |
| Ex. 10 | 1.10 | 1.32 | 0.09 | 1.29 | 0.14 | 1.32 | 0.11 |
| Ex. 11 | 1.10 | 1.33 | 0.07 | 1.35 | 0.09 | 1.31 | 0.07 |
| Com. Ex. 1 | 1.00 | 1.32 | 0.07 | 1.32 | 0.16 | 1.30 | 0.11 |
| Com. Ex. 2 | 1.10 | 1.33 | 0.13 | 1.33 | 0.25 | 1.30 | 0.12 |
| Com. Ex. 3 | 1.15 | 1.33 | 0.07 | 1.33 | 0.16 | 1.30 | 0.11 |
| Com. Ex. 4 | 0.63 | 1.23 | 0.09 | 1.23 | 0.13 | 1.20 | 0.10 |
| Com. Ex. 5 | 0.60 | 1.18 | 0.09 | 1.18 | 0.14 | 1.16 | 0.11 |
| Com. Ex. 6 | 0.63 | 1.20 | 0.07 | 1.20 | 0.10 | 1.18 | 0.09 |
| Com. Ex. 7 | 0.70 | 1.28 | 0.07 | 1.28 | 0.10 | 1.27 | 0.09 |
| Com. Ex. 8 | 0.60 | 1.25 | 0.09 | 1.25 | 0.14 | 1.24 | 0.10 |
| Com. Ex. 9 | 0.60 | 1.18 | 0.07 | 1.18 | 0.10 | 1.13 | 0.09 |

From above result, it is understood that the present invention produces a thermosensitive materials which has a high sensitivity and an improvement optical density of background area, and an excellent storage stability.

(Preparation of Thermosensitive Recording Member Sheets)

Moreover, a sheet of 60 g/m$^2$ thickness of wood free paper was coated with a liquid for forming undercoat layer shown in Table 6 to prepare 3.0 g/m$^2$ thickness of layer at dried state and dried. Next, thereon was coated with coating liquids prepared by using dye dispersion liquids and developer dispersion liquids shown Table 4, and dried to prerare thermosensitive layers of 0.45 g/m$^2$ thickness at dried state, then the thermosensitive layers were coated with resinous solution to provide resin layer having 1.5 g/m$^2$ thickness at dried state, then the thermosensitive members prepared were super-calendered, to obtain thermosensitive members shown by Examples and Comparative Examples. And following evalutions were conducted with the thermosensitive members.

(Evaluation Tests)

(Coloring Sensitivity)

Using a thermal print testing machine with a thinfilm thermal head made by Matsushita Electric Component Ltd., the calendered thermosensitive members were, under the conditions of electric power imposed the thermalhead of 0.45 W/ one dot, recording time of 20 m sec. for one line, and scanning resolution of 8×385 dots/mm, printings with pulse width of 0.0 to 0.7 mm sec. at intervals of 1 m sec, colored(recorded) to print images, and the images colored on the thermosensitive members were measured their optical densities using a Macbeth densitometer RD-914, the measured resultants were calculated to detemine a pulse width required for obtaining optical density 1.0 of colored image.

The sensitivity is calculated, in comparison with Comparison 1 as the standard, by a calculation formula of; Improved Ratio of Sensitivity=(pulse width of Comparison 1)/(pulse width of sample subject). The greater of the result shows the higher sensitivity (the thermal response).

(Resistance to Heat)

The samples which have not yet been recorded therefore have only background area were left at 80° C. for 15 hours and optical densities of the background area were examined.

(Hunter Brightness of Background Area)

The samples which have not yet been recorded therefore have only background area were measured optical densities at background areas with the state being accumulated to 10 sheets thereof, by use of digital Hunter brightness meter. The results are shown in Table 6.

TABLE 6

| | undercoat layer | dye-dispersion liquid | comparative sensitivity | heat resistivity test of background area | | hunter brightness of background area |
|---|---|---|---|---|---|---|
| | | | | before | after | |
| Ex. 12 | (4)-1 | A-7 | 1.07 | 0.08 | 0.16 | 79.6 |
| Ex. 13 | (4)-1 | A-8 | 1.09 | 0.08 | 0.15 | 79.6 |
| Ex. 14 | (4)-1 | A-9 | 1.07 | 0.08 | 0.17 | 79.4 |
| Ex. 15 | (4)-1 | A-10 | 1.06 | 0.08 | 0.16 | 79.7 |
| Ex. 16 | (4)-1 | A-11 | 1.07 | 0.08 | 0.17 | 80.1 |
| Ex. 17 | (4)-1 | A-12 | 1.08 | 0.08 | 0.16 | 80.1 |
| Ex. 18 | (4)-1 | A-13 | 1.12 | 0.09 | 0.14 | 79.7 |
| Ex. 19 | (4)-1 | A-14 | 1.09 | 0.08 | 0.15 | 80.0 |
| Ex. 20 | (4)-1 | A-15 | 1.09 | 0.10 | 0.16 | 78.4 |
| Ex. 21 | (4)-1 | A-16 | 1.08 | 0.09 | 0.12 | 79.7 |
| Ex. 22 | (4)-1 | A-17 | 1.14 | 0.12 | 0.17 | 78.2 |

TABLE 6-continued

| | undercoat layer | dye-dispersion liquid | comparative sensitivity | heat resistivity test of background area | | hunter brightness of background area |
|---|---|---|---|---|---|---|
| | | | | before | after | |
| Ex. 23 | (4)-1 | A-18 | 1.13 | 0.11 | 0.15 | 78.3 |
| Ex. 24 | (4)-1 | A-24 | 1.07 | 0.08 | 0.17 | 79.6 |
| Ex. 25 | (4)-1 | A-25 | 1.09 | 0.08 | 0.16 | 79.6 |
| Ex. 26 | (4)-1 | A-26 | 1.07 | 0.08 | 0.16 | 79.4 |
| Ex. 27 | (4)-1 | A-27 | 1.06 | 0.08 | 0.16 | 79.7 |
| Ex. 28 | (4)-1 | A-30 | 1.06 | 0.08 | 0.17 | 79.2 |
| Ex. 29 | (4)-1 | A-34 | 1.07 | 0.09 | 0.18 | 79.3 |
| Ex. 30 | (4)-1 | A-38 | 1.06 | 0.09 | 0.18 | 79.1 |
| Ex. 31 | (4)-1 | B-5 | 1.08 | 0.10 | 0.20 | 76.2 |
| Ex. 32 | (4)-1 | B-6 | 1.07 | 0.10 | 0.21 | 76.7 |
| Ex. 33 | (4)-1 | B-7 | 1.11 | 0.10 | 0.20 | 76.9 |
| Ex. 34 | (4)-1 | B-8 | 1.06 | 0.10 | 0.22 | 76.0 |
| Com. Ex. 10 | (4)-1 | B-1 | 1.00 | 0.08 | 0.15 | 79.6 |
| Com. Ex. 11 | (4)-1 | B-2 | 1.06 | 0.16 | 0.38 | 70.5 |
| Com. Ex. 12 | (4)-1 | B-9 | 1.01 | 0.10 | 0.18 | 78.6 |
| Com. Ex. 13 | (4)-1 | B-10 | 1.01 | 0.10 | 0.19 | 78.9 |
| Com. Ex. 14 | (4)-1 | B-11 | 1.01 | 0.11 | 0.15 | 79.2 |
| Com. Ex. 15 | (4)-1 | B-13 | 1.12 | 0.21 | 0.35 | 70.0 |
| Com. Ex. 16 | (4)-1 | B-14 | 1.13 | 0.22 | 0.34 | 71.1 |
| Com. Ex. 17 | (4)-1 | B-15 | 1.11 | 0.25 | 0.36 | 69.2 |
| Com. Ex. 18 | (4)-1 | B-16 | 1.13 | 0.22 | 0.33 | 69.5 |
| Com. Ex. 19 | (4)-1 | B-17 | 1.09 | 0.20 | 0.22 | 72.3 |
| Com. Ex. 20 | (4)-2 | A-1 | 1.00 | 0.08 | 0.15 | 79.5 |

From above results shown in Table 6, it is understood that there are provided an excellent thermosensitive member which has a high sensitivity, a high brightness of background area, and an improved heat-resistance of background area, and those excellent properties of the present invention are caused by use of a surfactant having poly oxyethylene group(s), particularly by use of a surfactant having poly oxyethylene group(s) which is being prepared by condensating of poly oxyethylene units less than or equal to 15, by the surfactant which has group(s) selected from alkyl group (s), alkylphenyl group(s), phenylxylyl group(s), stylylphenyl group(s) at ether residue group(s) of side-end of the polyethylene group(s), by decreasing the content of finer particles having particle size less than 0.07 m of leuco dyeused in the thermosensitive member, and by use of polymer dispersant in combination with the surfactant having poly oxyethylene group(s), and the combination use of the surfactant and the polymer dispersant causes dispersion of the leuco dye which has an average particle size ranging from 0.10 to 0.30 m, and thereby the an excellent properties above described in thermosensitive member of the present invention is prepared.

What is claimed is:

1. A leuco dye dispersion liquid for a thermosensitive recording material wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%.

2. A leuco dye dispersion liquid for a thermosensitive recording material wherein the leuco dye is being dispersed with an anionic surfactant, while average particle diameter of the leuco dye ranges from 0.10 μm to 0.30 μm and content of particles less than or equal to 0.07 μm in diameter of the dye is not greater than 1.0%.

3. A leuco dye dispersion liquid for a thermosensitive recording material wherein the leuco dye is being dispersed with an nonionic surfactant, while average particle diameter of the leuco dye ranges from 0.10 μm to 0.30 μm and content of particles less than or equal to 0.07 μm in diameter of the dye is not greater than 1.0%.

4. A leuco dye dispersion liquid for a thermosensitive recording material wherein the leuco dye is being dispersed with an anionic surfactant and/or an nonionic surfactant, while average particle diameter of the leuco dye ranges from 0.10 μm to 0.20 μm and content of particles less than or equal to 0.07 μm in diameter of the dye is not greater than 1.0%.

5. A leuco dye dispersion liquid for a thermosensitive recording material wherein the leuco dye is being dispersed with an anionic surfactant having poly-oxyethylene group and/or an nonionic surfactant having poly-oxyethylene group, while average particle diameter of the leuco dye ranges from 0.10 μm to 0.30 μm and content of particles less than or equal to 0.07 μm in diameter of the dye is not greater than 1.0%.

6. A leuco dye dispersion liquid for a thermosensitive recording material wherein the leuco dye is being dispersed with an anionic surfactant having poly-oxyethylene group and/or an nonionic surfactant having poly-oxyethylene group, the poly-oxyethylene groups consist of oxyethylene groups not greater than 15 which are being poly-additioned, while average particle diameter of the leuco dye ranges from 0.10 μm to 0.30 μm and content of particles less than or equal to 0.07 μm in diameter of the dye is not greater than 1.0%.

7. A leuco dye dispersion liquid for a thermosensitive recording material wherein the leuco dye is being dispersed with an anionic surfactant having poly-oxyethylene group and/or an nonionic surfactant having poly-oxyethylene group, where ether residues positioned in side end of the poly-oxyethylene groups include an alkyl group, an alkylphenyl group, a phenyl-xylyl group, and a styryl-phenyl group, while average particle diameter of the leuco dye ranges from 0.10 μm to 0.30 μm and content of particles less than or equal to 0.07 μm in diameter of the dye is not greater than 1.0%.

8. A leuco dye dispersion liquid for a thermosensitive recording material, wherein the leuco dye is being dispersed with an anionic surfactant having poly-oxyethylene group and/or an nonionic surfactant having poly-oxyethylene group, the surfactants are included 5 to 25 percent by weight, while average particle diameter of the leuco dye ranges from 0.10 μm to 0.30 μm and content of particles less than or equal to 0.07 μm in diameter of the dye is not greater than 1.0%.

9. A leuco dye dispersion liquid for a thermosensitive recording material wherein the leuco dye is being dispersed with an anionic surfactant and an nonionic surfactant, and 1 to 10 percent by weight of silicon emulsion based on the leuco dye is contained in the dispersion liquid, while average particle diameter of the leuco dye ranges from 0.10 μm to 0.30 μm and content of particles less than or equal to 0.07 μm in diameter of the dye is not greater than 1.0%.

10. A leuco dye dispersion liquid for a thermosensitive recording material wherein the leuco dye is being dispersed with an anionic surfactant and an nonionic surfactant, and with a polymer dispersant having been added, while average particle diameter of the leuco dye ranges from 0.10 μm to 0.30 μm and content of particles less than or equal to 0.07 μm in diameter of the dye is not greater than 1.0%.

11. A leuco dye dispersion liquid for a thermosensitive recording material wherein the leuco dye is being dispersed with an anionic surfactant and an nonionic surfactant, and with polyvinyl alcohol acryl-sulfonic acid metal salt and/or partially saponified polyvinyl alcohol having been added, while average particle diameter of the leuco dye ranges from 0.10 μm to 0.30 μm and content of particles less than or equal to 0.07 μm in diameter of the dye is not greater than 1.0%.

12. A method of preparation of a leuco dye dispersion liquid for a thermosensitive recording material, the liquid contains an anionic surfactant and/or an nonionic surfactant, wherein the method includes a step of dispersing a leuco dye by a sand-mill using a glass medium of 0.8 to 0.3 mm in the diameter, to one having average particle diameter ranges from 0.10 μm to 0.30 μm and content of particles less than 0.07 μm in diameter of the dye is not greater than 1.0%.

13. A method of preparation of a leuco dye dispersion liquid for a thermosensitive recording material, the liquid contains an anionic surfactant and/or an nonionic surfactant, wherein the method includes a step of dispersing a leuco dye by a sand-mill using a zirconia medium of 0.8 to 0.3 mm in the diameter, to one having average particle diameter ranges from 0.10 μm to 0.30 μm and content of particles less than 0.07 μm in diameter of the dye is not greater than 1.0%.

14. A method of preparation of a leuco dye dispersion liquid for a thermosensitive recording material, the liquid contains an anionic surfactant and/or an nonionic surfactant, wherein the method includes steps of dispersing a leuco dye by coarse milling means using a dispersing medium of 0.8 to 1.0 mm in the diameter, then dispersing the leuco dye by finer milling means using dispersing medium of 0.3 to 0.8 mm in the diameter, to one having average particle diameter ranges from 0.10 μm to 0.30 μm and content of particles less than 0.07 μm in diameter of the dye is not greater than 1.0%.

15. A method of preparation of a leuco dye dispersion liquid for a thermosensitive recording material, the liquid contains an anionic surfactant and/or an nonionic surfactant, wherein the method includes a step of dispersing a leuco dye by a SC-mill using a zirconia medium of 0.8 to 0.3 mm in the diameter, to one having average particle diameter ranges from 0.10 μm to 0.30 μm and content of particles less than 0.07 μm in diameter of the dye is not greater than 1.0%.

16. A method of preparation of a leuco dye dispersion liquid for a thermosensitive recording material, the liquid contains an anionic surfactant and/or an nonionic surfactant, wherein the method includes a step of dispersing a leuco dye by a ring-mill using a zirconia medium of 0.8 to 0.3 mm in the diameter, to one having average particle diameter ranges from 0.10 μm to 0.30 μm and content of particles less than 0.07 μm in diameter of the dye is not greater than 1.0%.

17. A method of preparation of a leuco dye dispersion liquid for a thermosensitive recording material, the liquid contains an anionic surfactant and/or an nonionic surfactant, wherein the method includes a step of dispersing a leuco dye by a spike-mill using a zirconia medium of 0.8 to 0.3 mm in the diameter, to one having average particle diameter ranges from 0.10 μm to 0.30 μm and content of particles less than 0.07 μm in diameter of the dye is not greater than 1.0%.

18. A thermosensitive recording member containing a supporting substrate, thereon provided a thermosensitive recording layer which includes a thermosensitive recording material made from a leuco dye dispersion liquid for the thermosensitive recording material and a developer contained therein, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%.

19. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 1.0 μm to 0.30 μm and content of particles less than or equal to 0.07 μm in diameter of the dye is not greater than 1.0%, the developer makes colored the leuco dye when the recording material is heated, and the intermediate layer contains hollow particles of thermoplastic resin.

20. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes a derivative of poly 4-hydroxy benzoic acid.

21. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes a ureaurethane compound.

22. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes a diphenyl sulfone derivative represented by following General formula;

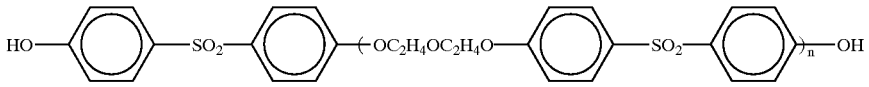

Where the n is integer of 1 to 12.

23. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes a developer containing sulfonyl aminocarbonylamido group.

24. A thermosensitive recording member containing a supporting substrate, thereon provided a thermosensitive recording layer includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes 4,4'-dihydroxydiphenyl sulfone (bisphenol S).

25. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes 4-iso-propoxy-4'-hydroxy diphenyl sulfone.

26. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%, the developer includes an oligomer composition obtained by polycondensation of a polyvalent(more than three or more functionals) isocyanate compound represented by General formula (3) and an aromatic amine represented by General formula (4)

X NCO a — General formula (3)

General formula (4)

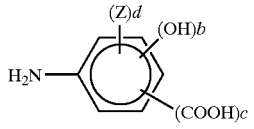

(where the X is a polyvalent group(three- or more-functional), the a is an integer of three or more, the b and the c are, respectively, integers in the scope of zero to five where b+c=a numeral ranging from 0 to 5, the Z represents hydrogen atom(s), alkyl group(s), alkenyl group(s), or aryl group(s), the aryl group(s) may form condensed ring attached thereto, the d is integer(s) in the scope of zero to four where b+c+d=a numeral ranging from 0 to 5).

27. A thermosensitive recording member containing a supporting substrate, thereon provided a thermosensitive recording layer which includes a thermosensitive recording material made from a leuco dye dispersion liquid for the thermosensitive recording material and a developer contained therein, and an intermediate layer provided between the supporting substrate and the thermosensitive recording layer, wherein the supporting substrate contains pulp recovered from used paper, the leuco dye is being dispersed with an anionic surfactant and an nonionic surfactant, while average particle diameter of the leuco dye ranges from 0.10 μm to 0.30 μm and content of particles less than or equal to 0.07 μm in diameter of the dye is not greater than 1.0%.

* * * * *